US005503307A

United States Patent [19]

Wilson et al.

[11] Patent Number: 5,503,307

[45] Date of Patent: Apr. 2, 1996

[54] QUICK RELEASE AUTOMATIC ELECTRIC CAULKING GUN

[76] Inventors: Steven J. Wilson, 167 Community Cir., Old Bridge, N.J. 08857; John H. Klock, 1800 Lake Ave., Scotch Plains, N.J. 07076

[21] Appl. No.: 400,718

[22] Filed: Mar. 8, 1995

[51] Int. Cl.[6] ..... B65D 88/54

[52] U.S. Cl. ..... 222/326; 222/333

[58] Field of Search ..... 222/326, 333, 222/386, 390, 391

[56] References Cited

U.S. PATENT DOCUMENTS

| | | | |
|---|---|---|---|
| 3,635,378 | 1/1972 | DeHart | 222/333 |
| 3,861,567 | 1/1975 | Davis, Jr. | 222/333 |
| 3,985,273 | 10/1976 | Davis, Jr. | 222/326 |
| 4,114,781 | 9/1978 | Doyel | 222/326 |
| 4,171,072 | 10/1979 | Davis, Jr. | 222/326 |
| 4,583,934 | 4/1986 | Hata et al. | 222/333 |
| 5,058,781 | 10/1991 | Aronie et al. | 222/326 |
| 5,188,259 | 2/1993 | Petit | 222/63 |
| 5,353,971 | 10/1994 | Vaziri | 222/326 |

*Primary Examiner*—Andres Kashnikow
*Assistant Examiner*—Philippe Derakshani
*Attorney, Agent, or Firm*—Matthew J. Hodulik

[57] ABSTRACT

This invention relates to an electrical caulking gun utilizing a triggering mechanism that controls both the mechanical and electrical operations of a plunger unit that applies axial pressure against a caulking cartridge. The triggering mechanism sits in a grooved channel in a caulking cartridge receptacle and comprises of a trigger rack with a series of wedges on its top and a gear rack, which lies atop the trigger rack, with a series of reciprocating wedges on its bottom that meshes with the wedges on the trigger rack. The wedges on the trigger rack and gear rack cooperate with each other to push the gear rack upward when the trigger rack is moved rearward. The gear rack has a series of gears on its top such that, when pushed upward, they will engage with a drive gear protruding from the plunger unit. The drive gear drives the plunger unit, and is in turn driven by an electrical motor in the plunger unit. The trigger rack, when pulled rearward to its maximum position, will activate the electrical motor. This triggering mechanism is designed to have the drive gear engage with the gear rack before the electrical motor is activated.

20 Claims, 6 Drawing Sheets

QUICK RELEASE AUTOMATIC ELECTRIC CAULKING GUN

BACKGROUND OF THE INVENTION

1. Field of the Invention

This invention relates to an automatic dispensing hand-held caulking gun which is trigger activated and motor driven.

2. Description of the Related Art

Caulking guns which are designed primarily for dispensing prepackaged caulk held in containers or cylindrical cartridges are well known in the prior art. They are generally two types: manual and automatic dispensers. The manual type are widely used at present because of their cost advantage over automatic dispensers and because automatic dispensers today do not provide any real advantages over the manual type apart from the convenience of motor driven dispensed caulk.

Both manual and electrical caulking guns have in common a serious drawback which occurs when the user has completed the caulking task. The pressure applied to the cartridge remains after the task is completed unless the user releases the pressure manually. Even the most skilled artisan can not move quickly enough to avoid dispensing unwanted caulk which must be handled carefully and disposed of.

In the case of manual dispenser, pressure is applied axially along the cartridge as the trigger is pulled rearwardly. To release the axial pressure, the plunger must be manually disengaged from the trigger mechanism. This requires the user to change hands and to reposition the assembly, taking additional time and resulting in the discharge of unwanted caulk. Automatic or electric caulking guns have similar problems.

Alan B. Aronie and Joel Aronie attempted to resolve the problem of dispensing unwanted caulk using a quick pressure release drive means in U.S. Pat. No. 5,058,781. In that patent, the caulking material is dispensed by axial movement of an exterior threaded tube which is driven by a rotating ring gear interiorly threaded to mate with the tube. The tube is longitudinally split and is expandable/collapsible by a bushing within the tube. In the expanded position, the tube is engaged with the ring gear and axial pressure can be applied or maintained against the caulking cartridge. In the collapsed position, the tube is disengaged from the ring gear and axial pressure is released.

An external power source, such as an electric power drill, was used to drive the ring gear. Undesirable qualities, such as cost and bulk associated with power drills, became added features to the Aronie et al patent. Additionally, the means by which the power drill was attached to the caulking gun and the positioning of the power drill made the caulking gun unbalanced and cumbersome. To further complicate things, both hands were needed to efficiently operate the caulking gun: one hand to control the electrical operation of the gun and another hand to control the mechanical operation of repositioning the bushing within the tube to release the axial pressure.

The object of the present invention is to provide a caulking gun that releases pressure immediately from the caulking cartridge and addresses the design flaws in the Aronie patent with a novel plunger unit and triggering mechanism. Specifically, the present invention offers a quick release self-contained balanced handling caulking gun with a single triggering mechanism that controls both the mechanical and electrical aspects of the plunger unit.

SUMMARY OF THE INVENTION

In the present invention, an electrical apparatus for dispensing caulking material from a typical caulking cartridge with a tubular body, a nozzle and an end piece, is taught utilizing a novel plunger unit and triggering mechanism. This comprises of a caulking cartridge receptacle, a handle, a plunger unit, an electrical switch, a trigger rack and a gear rack. The caulking cartridge receptacle has a grooved channel and is mounted atop of the handle. Slidably mounted within the grooved channel is the plunger unit for applying pressure axially to the caulking cartridge through its end piece. The plunger unit has a drive gear and an electrical motor with a worm gear. The worm gear is engaged with the drive gear and transfers power from the electrical motor to the drive gear causing it to rotate and advance the plunger unit. The electrical switch has a positive "on" and a positive "off" position for electrically connecting and disconnecting the electrical power supply to and from the electrical motor. Underneath the plunger unit within the grooved channel lies the trigger rack. The trigger rack has a trigger and wedges with sloping planes. The trigger has a forward and a rearward position and extends vertically beyond the grooved channel to the handle. The trigger is exposed forward of the handle enabling an operator to slide the trigger back and forth between the forward and rearward positions. The trigger cooperates with the electrical switch to turn the electrical switch positive "on" when the trigger is in the rearward position and to turn the electrical switch positive "off" when the trigger is in not in the rearward position. Resting atop of the trigger rack and underneath the plunger unit within the grooved channel is the gear rack. The gear rack has gears and reciprocating wedges that meshes with the drive gear and the wedges on the trigger rack, respectively. The reciprocating wedges cooperate with the wedges on the trigger rack to push the gear rack upward as the trigger moves away from the forward position and towards the rearward position. The gear rack is spaced a distance apart from the drive gear of the plunger unit sufficient to disengage the gears from the drive gear when the trigger is in the forward position and to engage the gears with the drive gear as the trigger moves away from the forward position and towards the rearward position. In the rearward position, the gears are engaged with the drive gear and the electrical switch is positive "on" providing the necessary traction and electrical power for the plunger unit to advance forward and exert axial pressure against the caulking cartridge. In the forward position, axial pressure against the caulking cartridge is released.

To provide a wider range of control over the caulking flow, a third position, i.e., an intermediate position, is added to the trigger. In this position, the drive gear is engaged with the gears on the gear rack but the electrical switch is positive "off." The plunger unit stays flushed against the end piece of the caulking cartridge to allow the operator to slow the rate of caulk being dispensed by maintaining axial pressure.

Advantageously, a cutting means may be mounted underneath the plunger unit forward of the drive blade for cutting the tubular body of the caulking cartridge as the plunger unit advance forward facilitating the movement of the plunger unit. A spring may be interposed between the handle and the trigger to maintain the trigger in the forward position when no pressure is being exerted on the trigger by an operator. Additional springs may be interposed between the channel body and the gear rack to hold the gear rack positively positioned against the trigger rack when the trigger is in the forward position.

These and other features, aspects, and advantages of the present invention will become better understood with regard to the following description, appended claims, and accompanying drawings.

DESCRIPTION

Figure 1:
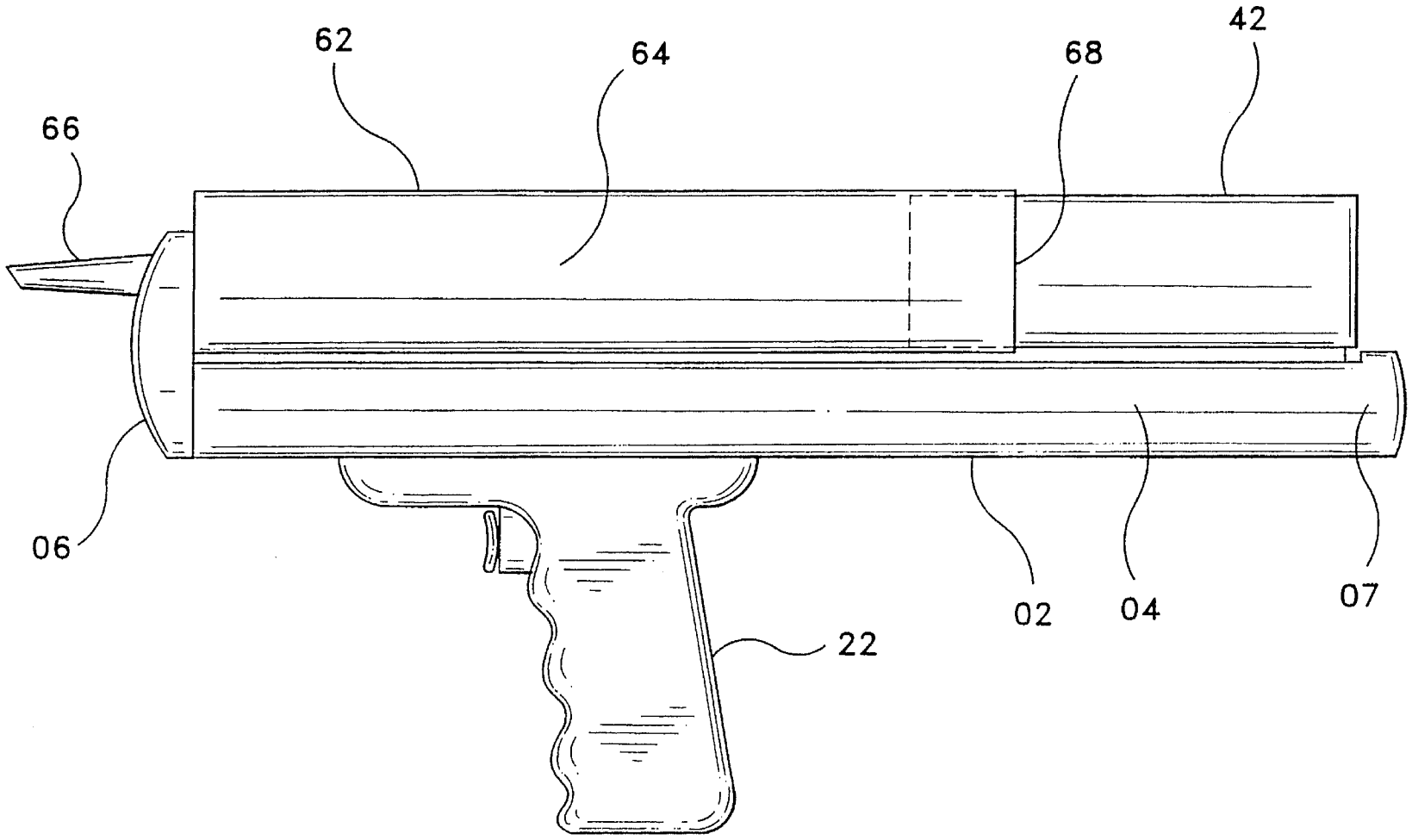
FIG. 1 depicts a side view of the caulking gun.
Figure 5:
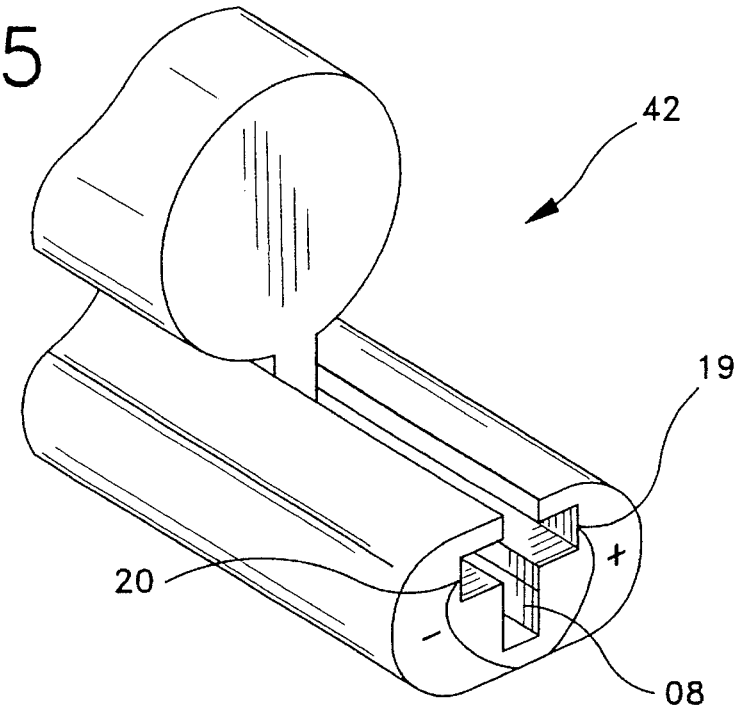
FIG. 5 depicts a cross-sectional perspective of the rear of the caulking gun.
Figure 8:
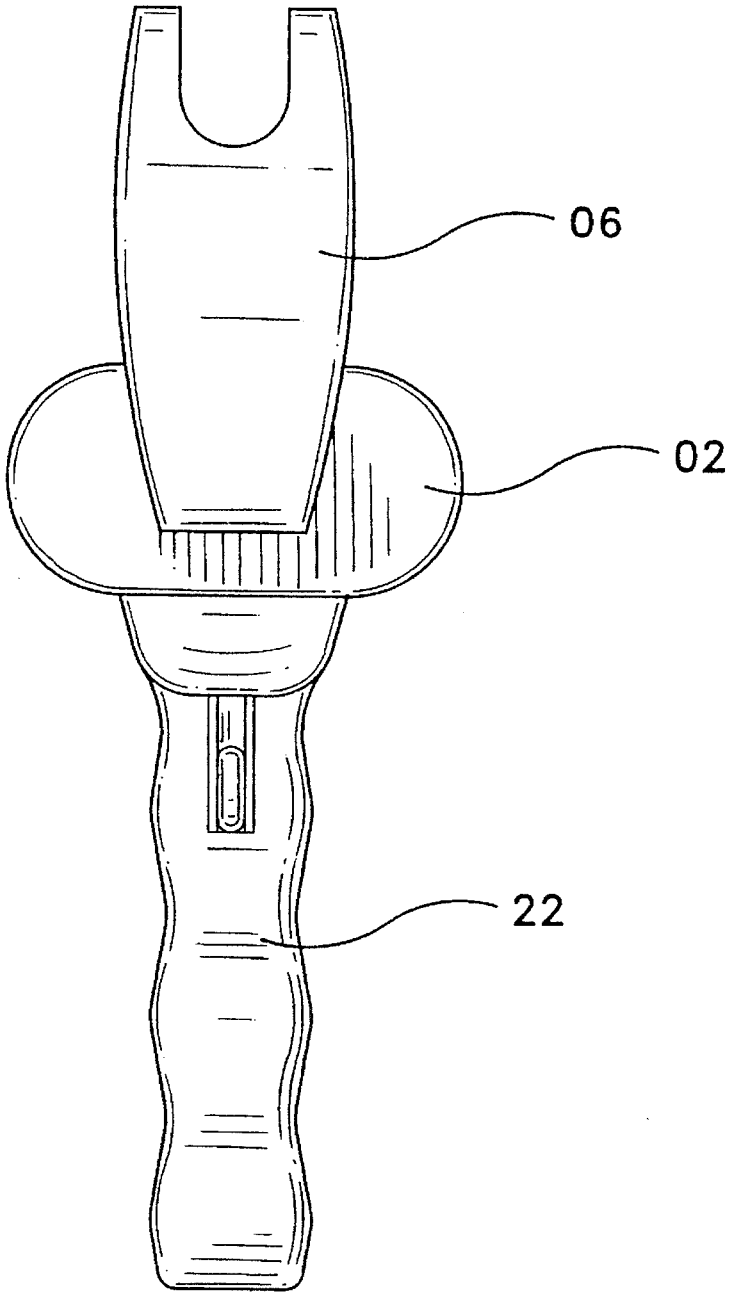
FIG. 8 depicts a frontal view of the tube holder.

As shown in FIG. 1, the present invention comprises a caulking cartridge receptacle 02, a handle 22 and a plunger 42. The caulking cartridge receptacle 02 comprises a channel body 04, a tube holder 06 and an end wall 07. The channel body 04 is approximately 13 inches in length and has a groove 08, as shown in FIG. 5, where the plunger 42 is slidably mounted. Along the sides of the groove 08 are anode contact strip 19 and cathode contact strip 20 for providing the means of electrical contact to the plunger 42 from an electrical power supply or a battery 24. Mounted to the front of channel body 04 is the tube holder 06. The typical caulking cartridge 62 having a tubular body 64, a nozzle 66 and an end piece 68, is held under control along the channel body 04 between the tube holder 06 and plunger 42. The tube holder 06 is preferably "U" shaped, as shown in FIG. 8, to permit the nozzle 66 to extend beyond the caulking cartridge receptacle 02. In the alternate, the tube holder 06 may be designed in any manner with an opening sufficient to allow the nozzle 66 to pass through when mounted along the caulking cartridge receptacle 02. Mounted to the back of the channel body 04 is the end wall 07 to contain the plunger 42 within the groove 08.

Figure 2:
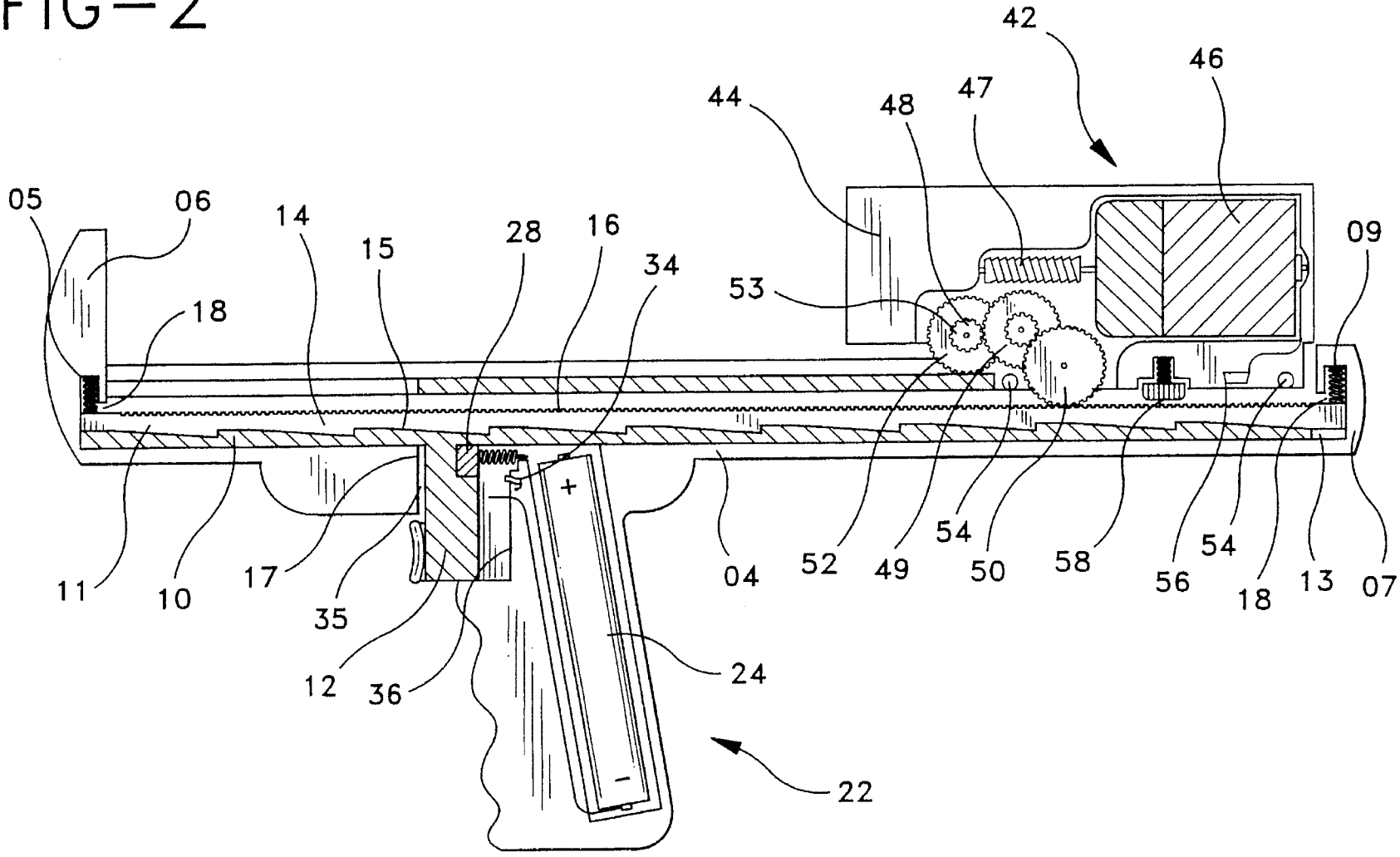
FIG. 2 depicts a cross-sectional side view of the caulking gun.

As shown in FIG. 2, housed within the channel body 04 and in the groove 08 is a trigger rack 10 and a gear rack 14. The trigger rack 10 slidably rests along the bottom of groove 08 and extends less than the entire length of the channel body 04. A space 13 is interposed between the trigger rack 10 and the end wall 07. The top of trigger rack 10 has a series of wedges 11 with flat horizontal planes at its peak and flat sloping planes between the flat horizontal planes and the adjacent wedges. The wedges are spaced apart from each other a distance greater than the length of the space 13. Vertically attached to the bottom of trigger rack 10 and extending through an opening 17 in groove 08 to the handle 22 is a trigger 12.

The gear rack 14 rests atop the trigger rack 10 and extends the entire length of the channel body 04. Along the bottom of the gear rack 14 is a series of reciprocating wedges 15 that meshes with the wedges 11 on trigger rack 10. Along the top of gear rack 14 is a series of gears 16 for engaging with a drive gear 50. Notches 05 and 09 in tube holder 06 and end wall 07, respectively, house push down springs 18 which are interposed between the tube holder 06 and gear rack 14 and between the end wall 07 and gear rack 14 to maintain the gear rack 14 positively positioned against the trigger rack 10.

Figure 3:
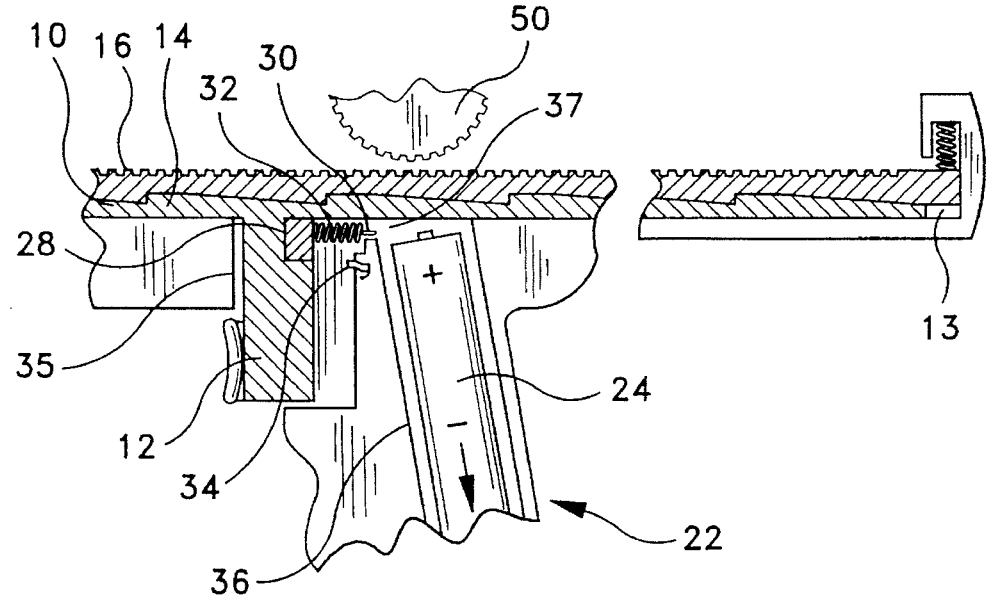
FIG. 3 depicts a view of the triggering mechanism in the forward position.
Figure 4:
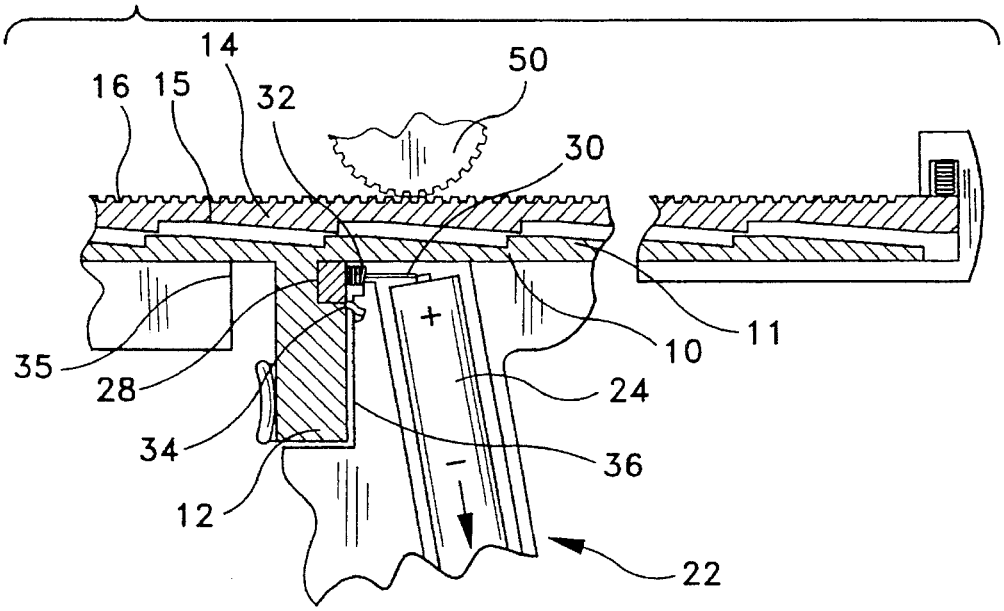
FIG. 4 depicts a view of the triggering mechanism in the rearward position.
Figure 7:
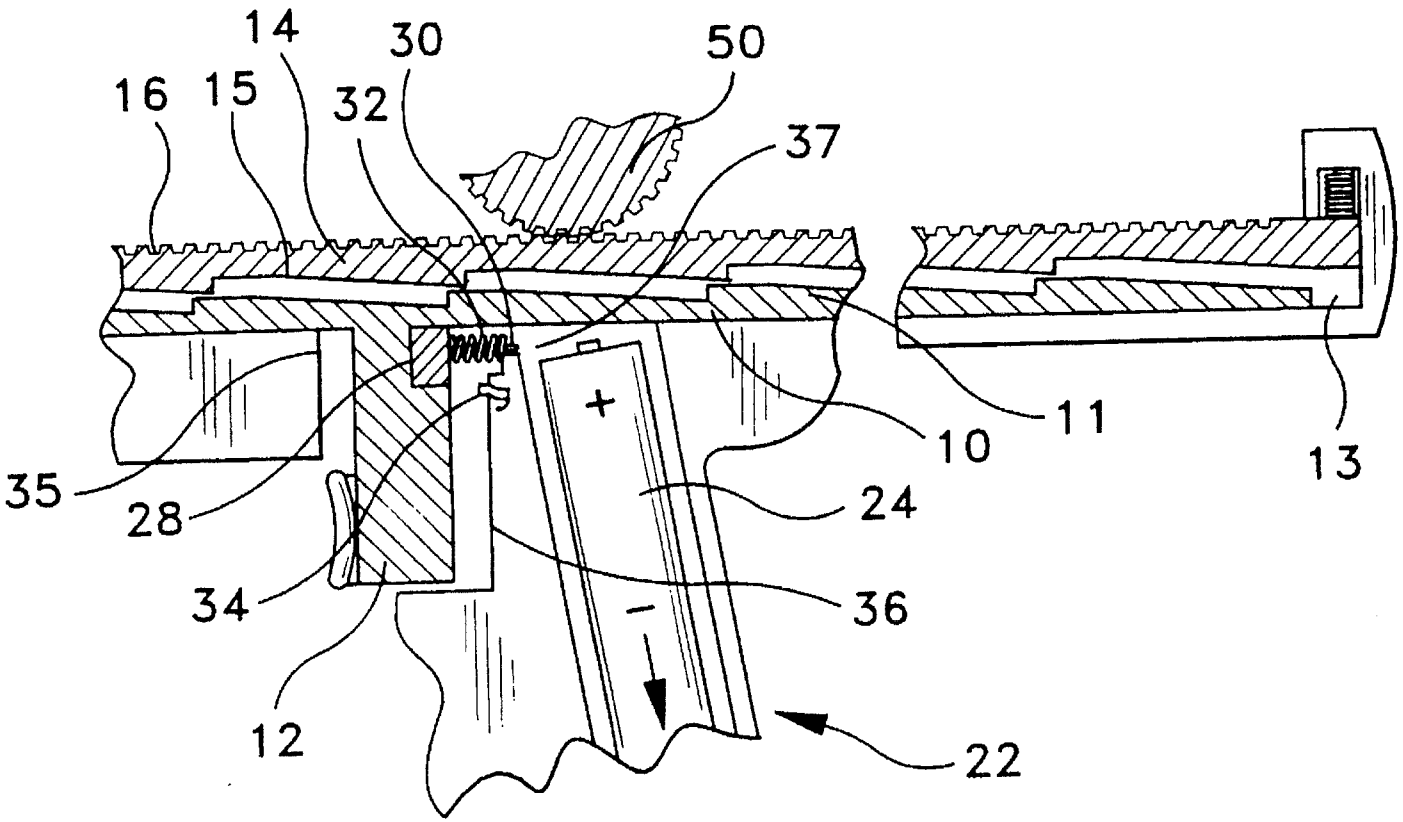
FIG. 7 depicts a view of the triggering mechanism in the intermediate position.

A shoulder 35 and a wall 36 within the handle 22 confines the lateral movement of the trigger 12 to a forward, a rearward and an intermediate position. The shoulder 35 and end wall 36 are spaced a distance apart sufficient to allow the trigger 12 to move the trigger rack 10 a distance equal to the length of space 13 when the trigger 12 is in the forward position. The trigger 12 abuts the shoulder 35 and the wall 36 in the forward and the rearward position, respectively, as shown in FIGS. 3 and 4. The intermediate position lies between the forward and rearward position, as shown in FIG. 7. In the forward position, the gear rack 14 is positively positioned against the trigger rack 10 and disengaged from the drive gear 50. As the trigger is pulled towards the wall 36, the series of wedges 11 cooperate with the reciprocating wedges 15 to push the gear rack 14 upward. At the intermediate and rearward position, the bottom of the reciprocating wedges 15 will lie atop of the flat horizontal plane of wedges 11 and the gears 16 on gear rack 14 will be engaged with the drive gear 50. The flat horizontal planes at the peaks of wedges 11 prevents the gear rack 14 from being pushed up any farther and exerting any necessary pressure against the drive gear 50 as the trigger 12 moves from the intermediate position to the rearward position.

The handle 22 is aligned with the opening 17 in groove 08 and is mounted vertically underneath the caulking cartridge receptacle 02. Preferably, the handle 22 and opening 17 are positioned forward along the caulking cartridge receptacle for balanced handling. The handle 22 preferably is designed with a pistol grip for comfort as well as ease of control. As shown in FIGS. 2, 3 and 4, the handle 22 houses the battery 24 and an electrical switch comprising of a pad 28, a shaft 30, a relief spring 32 and a tab 34. The pad 28, shaft 30 and tab 34 are electrically conductive. The trigger 12 is partially housed within the handle 22 and accessible to an operator, not shown, of the caulking gun. The wall 36 within the handle 22 separates the trigger 12 from the battery 24 and has an opening 37. The shaft 30 is electrically connected to and extends from the pad 28. The pad 28 and shaft 30 are positioned and mounted to the back of trigger 12 in a manner permitting the shaft 30 to extend through the opening 37 and make contact with the anode terminal of battery 24 when the trigger 12 is in the rearward position, as shown in FIG. 4. The tab 34 is mounted to the wall 36 and positioned away from the pad 28 allowing it to make contact with the pad 28 only when the trigger 12 is in the rearward position. When the trigger 12 is in the intermediate position, the shaft 30 and/or tab 34 do not touch or make contact with the battery 24 or pad 28, respectively. The relief spring 32 is wrapped around the shaft 30 and interposed between the trigger 12 and wall 36 to positively position the trigger 12 against the shoulder 35 in the forward position and to prevent the shaft 30 from coming into contact with the battery 24 until the trigger 12 is pulled by the operator. In the alternate, any electrical switch having a positive "on" and a positive "off" position, such as a toggle switch, may be used. A wire 38 electrically connects tab 34 to the anode contact strip 19, as shown in FIGS. 2 and 5. Likewise, a wire 39 electrically connects the cathode terminal of the battery 24 to the cathode contact strip 20.

The novel triggering mechanism of the trigger rack 12 and gear rack 16 offers several advantages. First, a single trigger controls both the mechanical aspect of engaging/disengaging the drive gear 50 with the gear rack 14 and the electrical aspects of supplying electrical power to the plunger 42.

Thus, only one hand is needed to operate the caulking gun. Second, by not allowing the drive gear 50 to rotate unless it is engaged with the gear rack 16, stripping of the gears 16 and drive gear 50 is avoided. Third, the flow of caulking material being dispensed can be better controlled by varying the axial pressure against the caulking cartridge 62. In the rearward position, the plunger 42 is advancing forward and applying continuous axial pressure. In the forward position, the drive gear 50 is disengaged from the gear rack 16 and the axial pressure is completely released stopping the flow of caulking material through nozzle 66. In the intermediate position, the forward movement of the plunger 42 is halted without disengaging the drive gear 50 from the gear rack 16. The plunger 42 remains flushed against the caulking cartridge 62 to allow the operator of the caulking gun to slow the rate of caulking material being dispensed through the nozzle 66 by maintaining axial pressure.

Figure 6:
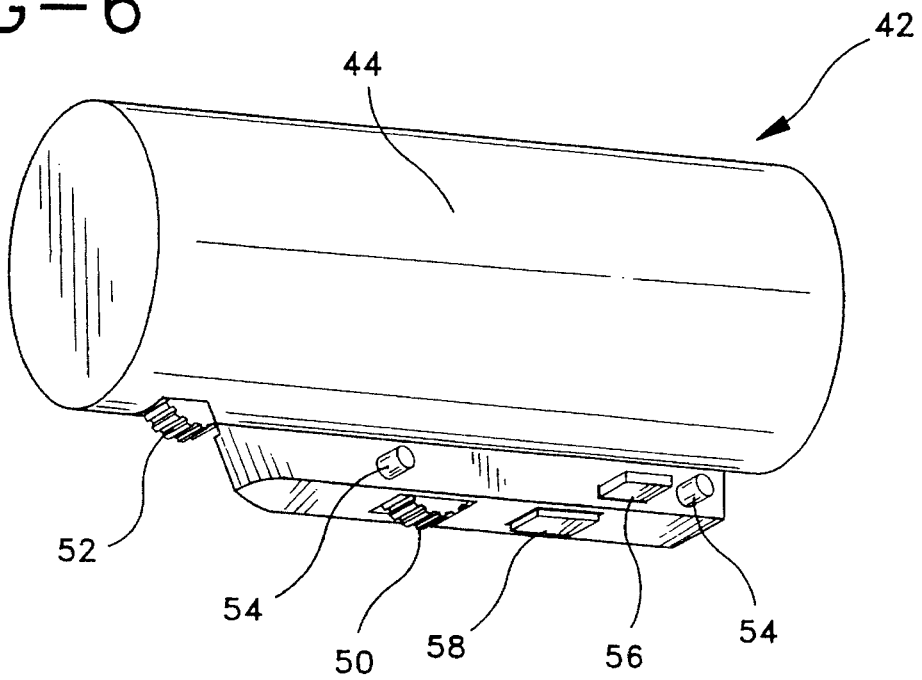
FIG. 6 depicts a perspective of the plunger unit.

The plunger 42 rides through the groove 08 in the channel body 04 and applies axial pressure to the caulking cartridge 62 through its end piece 68 forcing caulking material to be dispensed through the nozzle 66. The plunger 42 comprises a plunger body 44 which houses a motor 46, a main gear 48, a drive gear 50 and a cutting blade 52. The plunger body 44 is cylindrical in shape with a diameter slightly smaller than the end piece 68 of the caulking cartridge 62. As shown in FIG. 6, rollers 54 attached to the back and front of the external sides of the plunger body 44 guide the plunger 42 along the groove 08. Brushes 56 attached to the back of the external side of the plunger body 44 are positioned to make contact with the anode and cathode contact strips 19 and 20 and provide the necessary electrical connection to the motor 46. Electrical wires, not shown, connects the contact brushes 56 to the motor 46.

The motor 46 has a worm gear 47, as shown in FIG. 2, that supplies power to the main gear 48. A connecting gear 53 concentrically mounted to the cutting blade 52 transfers power from the main gear 48 to the cutting blade 52 causing the cutting blade 52 to rotate. The cutting blade 52 protrudes forward underneath of the plunger body 44 allowing it to cut through the tubular body 64 of the caulking cartridge 62 facilitating the movement of the plunger 42 as it advances forward. The cutting blade 52 also eliminates the requirement for a long plunger body 44. In the absence of the cutting blade 52, the plunger body 44 must be as long as the tubular body 64 to dispense all of the caulking material within the caulking cartridge 62. Otherwise the tubular body 64 would impede the advancement of the drive gear 50. In the alternate, a non-rotating cutting tool, such as a razor blade, may be positioned forward of the plunger body to cut through the tubular body 64. In another embodiment of the invention, not shown, the plunger 42 may have a telescoping body lengthening as it advances through the tubular body 64 of the caulking cartridge 62. This embodiment will eliminate the need for the cutting blade 52 and a lengthlet plunger body 44.

A connecting gear 49 concentrically mounted to the main gear 48 transfers power from the main gear 48 to the drive gear 50 causing it to rotate and advance the plunger 42 when it is engaged with the gear rack 16, as shown in FIG. 4. The drive gear 50 protrudes rearward underneath the plunger body 44 and is spaced a distance from the gears 16 on gear rack 14 permitting it to only engage with the gears 16 when the trigger 12 is either in the intermediate or rearward position. The ratio of the connecting gear 49 to the drive gear 50 depends upon the desired strength and speed of the plunger 42. A push down pad 58 interposed between the plunger body 44 and gear rack 16 ensures that the drive gear 50 is disengaged from the gear rack 16 when the trigger is in the forward position.

In view of the foregoing, it may be seen that the objects of the present invention have been achieved, including the following listed below.

A single triggering mechanism in the handle controls both the mechanical operation of engaging/disengaging the plunger and the electrical operation of supplying electrical power to the motor driving the plunger making the caulking gun simpler to control.

A plunger driving mechanism is used to apply axial pressure against the caulking cartridge to dispense the caulking material. The plunger can be disengaged to immediately release the axial pressure to the caulking cartridge and halt the flow of caulking material. Or the plunger can remain engaged but advancement halted to slow the flow of caulking material. A motor housed within the plunger unit drives the plunger eliminating the need for a costly and bulky external power source, such as a power drill.

Although the present invention has been described in considerable detail with reference to a certain preferred version thereof, other versions are possible. For example, a telescoping plunger may be used to apply axial pressure against the caulking cartridge. Therefore, the spirit and scope of the appended claims should not be limited to the description of the preferred version contained herein.

We claim:

1. An apparatus for dispensing caulking material from a caulking cartridge with a tubular body, a nozzle and an end piece, utilizing an electrical power supply comprising of:

a. a caulking cartridge receptacle having a grooved channel for receiving said caulking cartridge;

b. a handle on which said caulking cartridge receptacle is mounted;

c. a plunger unit slidably mounted within said grooved channel for applying pressure axially to said end piece of said caulking cartridge, said plunger unit having a drive gear and an electrical motor with a worm gear, said worm gear is engaged with said drive gear and transfers power from said electrical motor to said drive gear causing said drive gear to rotate and advance said plunger unit;

d. an electrical switch having a positive "on" and a positive "off" position for electrically connecting and disconnecting said electrical power supply to and from said electrical motor;

e. a trigger rack having a trigger and wedges with sloping planes, said trigger slidably mounted within said grooved channel underneath said plunger unit, said trigger having a forward and a rearward position, said trigger vertically extends beyond said grooved channel to said handle, said trigger exposed forward of said handle enabling the operator to slide said trigger back and forth between said forward and rearward positions, said trigger cooperates with said electrical switch to position said electrical switch positive "on" when said trigger is in said rearward position and to position said electrical switch positive "off" when said trigger is in not in said rearward position;

f. a gear rack having gears that meshes with said drive gear and reciprocating wedges that meshes with said wedges on said trigger rack, said gear rack positioned within said grooved channel atop of said trigger rack and underneath of said plunger unit, said reciprocating wedges cooperates with said wedges on said trigger rack to push said gear rack upward as said trigger moves away from said forward position and towards said rearward position, said gear rack is spaced a distance apart from said drive gear of said plunger unit sufficient to disengage said gears from said drive gear when said trigger is in said forward position and to engage said gears with said drive gear as said trigger moves away from said forward position and towards said rearward position.

2. The apparatus for dispensing caulking material from a caulking cartridge with a tubular body, a nozzle and an end piece, utilizing an electrical power supply as recited in claim 1 further comprising of:

g. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

3. The apparatus for dispensing caulking material from a caulking cartridge with a tubular body, a nozzle and an end piece, utilizing an electrical power supply as recited in claim 1 further comprising of:

g. a trigger spring interposed between said handle and said trigger to hold said trigger in said forward position when no pressure is being exerted by the operator on said trigger.

4. The apparatus for dispensing caulking material from a caulking cartridge with a tubular body, a nozzle and an end piece, utilizing an electrical power supply as recited in claim 1 further comprising of:

g. gear springs interposed between said caulking cartridge receptacle and said gear rack to hold said gear rack positively positioned against said trigger rack when said trigger is in said forward position.

5. The apparatus for dispensing caulking material from a caulking cartridge with a tubular body, a nozzle and an end piece, utilizing an electrical power supply as recited in claim 1 wherein said handle is positioned forward along said caulking cartridge receptacle.

6. The apparatus for dispensing caulking material from a caulking cartridge with a tubular body, a nozzle and an end piece, utilizing an electrical power supply as recited in claim 1 wherein said handle has a pistol grip.

7. The apparatus for dispensing caulking material from a caulking cartridge with a tubular body, a nozzle and an end piece, utilizing an electrical power supply as recited in claim 1 further comprising of:

g. a cutting means mounted underneath said plunger unit forward of said drive gear for cutting said tubular body of said caulking cartridge as said plunger advances forward.

8. The apparatus for dispensing caulking material from a caulking cartridge with a tubular body, a nozzle and an end piece, utilizing an electrical power supply as recited in claim 7 further comprising of:

h. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

9. The apparatus for dispensing caulking material from a caulking cartridge with a tubular body, a nozzle and an end piece, utilizing an electrical power supply as recited in claim 7 further comprising of:

h. a trigger spring interposed between said handle and said trigger to hold said trigger in said forward position when no pressure is being exerted by the operator on said trigger; and i. gear springs interposed between said caulking cartridge receptacle and said gear rack to hold said gear rack positively positioned against said trigger rack when said trigger is in said forward position.

10. The apparatus for dispensing caulking material from a caulking cartridge with a tubular body, a nozzle and an end piece, utilizing an electrical power supply as recited in claim 7 further comprising of:

j. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

11. An apparatus for dispensing caulking material from a caulking cartridge with a tubular body, a nozzle and an end piece, utilizing an electrical power supply comprising of:

a. a caulking cartridge receptacle having a grooved channel for receiving said caulking cartridge;

b. a handle on which said caulking cartridge receptacle is mounted;

c. a plunger unit slidably mounted within said grooved channel for applying pressure axially to said end piece of said caulking cartridge, said plunger unit having a drive gear and an electrical motor with a worm gear, said worm gear is engaged with said drive gear and transfers power from said electrical motor to said drive gear causing said drive gear to rotate and advance said plunger unit;

d. an electrical switch having a positive "on" and a positive "off" position for electrically connecting and disconnecting said electrical power supply to and from said electrical motor;

e. a trigger rack having a trigger and wedges, said trigger slidably mounted within said grooved channel underneath said plunger unit, said trigger having a forward, a rearward and an intermediate position, said trigger vertically extends beyond said grooved channel to said handle, said trigger exposed forward of said handle enabling the operator to slide said trigger back and forth between said forward, rearward and intermediate positions, said trigger cooperates with said electrical switch to position said electrical switch positive "on" when said trigger is in said rearward position and to position said electrical switch positive "off" when said trigger is in not in said rearward position, said wedges having horizontal planes at its peaks and sloping between said horizontal planes and adjacent wedges;

f. a gear rack having gears that meshes with said drive gear and reciprocating wedges that meshes with said wedges on said trigger rack, said gear rack positioned within said grooved channel atop of said trigger rack and underneath of said plunger unit, said reciprocating wedges cooperates with said wedges on said trigger rack to push said gear rack upward as said trigger moves away from said forward position and towards said rearward position, said gear rack is spaced a distance apart from said drive gear of said plunger unit sufficient to disengage said gears from said drive gear when said trigger is in said forward position and to engage said gears with said drive gear when said trigger is in said intermediate position or rearward position.

12. The apparatus for dispensing caulking material from a caulking cartridge with a tubular body, a nozzle and an end piece, utilizing an electrical power supply as recited in claim 11 further comprising of:

g. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

13. The apparatus for dispensing caulking material from a caulking cartridge with a tubular body, a nozzle and an end piece, utilizing an electrical power supply as recited in claim 11 further comprising of:

g. a trigger spring interposed between said handle and said trigger to hold said trigger in said forward position when no pressure is being exerted by the operator on said trigger.

14. The apparatus for dispensing caulking material from a caulking cartridge with a tubular body, a nozzle and an end piece, utilizing an electrical power supply as recited in claim 11 further comprising of:

g. gear springs interposed between said caulking cartridge receptacle and said gear rack to hold said gear rack positively positioned against said trigger rack when said trigger is in said forward position.

15. The apparatus for dispensing caulking material from a caulking cartridge with a tubular body, a nozzle and an end piece, utilizing an electrical power supply as recited in claim 11 wherein said handle is positioned forward along said caulking cartridge receptacle.

16. The apparatus for dispensing caulking material from a caulking cartridge with a tubular body, a nozzle and an end piece, utilizing an electrical power supply as recited in claim 11 wherein said handle has a pistol grip.

17. The apparatus for dispensing caulking material from a caulking cartridge with a tubular body, a nozzle and an end piece, utilizing an electrical power supply as recited in claim 11 further comprising of:

g. a cutting means mounted underneath said plunger unit forward of said drive gear for cutting said tubular body of said caulking cartridge as said plunger advances forward.

18. The apparatus for dispensing caulking material from a caulking cartridge with a tubular body, a nozzle and an end piece, utilizing an electrical power supply as recited in claim 17 further comprising of:

h. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

19. The apparatus for dispensing caulking material from a caulking cartridge with a tubular body, a nozzle and an end piece, utilizing an electrical power supply as recited in claim 17 further comprising of:

h. a trigger spring interposed between said handle and said trigger to hold said trigger in said forward position when no pressure is being exerted by the operator on said trigger; and i. gear springs interposed between said caulking cartridge receptacle and said gear rack to hold said gear rack positively positioned against said trigger rack when said trigger is in said forward position.

20. The apparatus for dispensing caulking material from a caulking cartridge with a tubular body, a nozzle and an end piece, utilizing an electrical power supply as recited in claim 17 further comprising of:

j. a tube holder mounted to the front of said caulking cartridge receptacle for holding said caulking cartridge under control as axial pressure is being applied to said end piece of said caulking cartridge by said plunger unit, said tube holder having an opening to allow said nozzle of said caulking cartridge to extend beyond said caulking cartridge receptacle.

* * * * *